United States Patent [19]

Jancsovics

[11] Patent Number: 4,686,810

[45] Date of Patent: Aug. 18, 1987

[54] METHOD FOR LEAKPROOFING BUILDING WALLS, AS WELL AS INSERTION ELEMENT FOR IMPLEMENTING THE METHOD

[76] Inventor: István Jancsovics, 65. Kossuth u., 8651 Balatonszabadi, Hungary

[21] Appl. No.: 723,966

[22] PCT Filed: Jul. 1, 1983

[86] PCT No.: PCT/HU83/00035

§ 371 Date: Feb. 28, 1985

§ 102(e) Date: Feb. 28, 1985

[87] PCT Pub. No.: WO85/00395

PCT Pub. Date: Jan. 31, 1985

[30] Foreign Application Priority Data

May 27, 1982 [HU] Hungary ..... 1705/82

[51] Int. Cl.[4] ..... E04B 1/62

[52] U.S. Cl. ..... 52/743; 52/404; 52/442

[58] Field of Search ..... 52/743, 404, 442, 167

[56] References Cited

U.S. PATENT DOCUMENTS

| | | | |
|---|---|---|---|
| 2,187,324 | 1/1940 | Many | 52/743 |
| 3,895,472 | 7/1975 | Steinhauer et al. | 52/743 |
| 4,136,498 | 1/1979 | Kanigan | 52/442 |
| 4,334,397 | 6/1982 | Hitz | 52/442 |

FOREIGN PATENT DOCUMENTS

| | | | |
|---|---|---|---|
| 228987 | 8/1963 | Austria . | |
| 335689 | 3/1977 | Austria . | |
| 338479 | 8/1977 | Austria . | |
| 2483985 | 12/1981 | France | 52/404 |
| 2079415 | 1/1982 | United Kingdom | 52/404 |

*Primary Examiner*—Carl D. Friedman
*Assistant Examiner*—Caroline D. Dennison
*Attorney, Agent, or Firm*—Young & Thompson

[57] ABSTRACT

Building walls are leakproofed by cutting a horizontal slot through the wall, and inserting therein load-bearing elements of grid-like form made of a synthetic resin, with relatively harder balls at the intersections of the grid, these balls being disposed in load-bearing relationship between the wall sections and projecting above and below the grid. The openwork around the grid and the balls is filled with an injected insulating and setting agent in the form of a synthetic mortar.

2 Claims, 8 Drawing Figures

METHOD FOR LEAKPROOFING BUILDING WALLS, AS WELL AS INSERTION ELEMENT FOR IMPLEMENTING THE METHOD

The invention relates to a method for leakproofing building walls, as well as insertion element for implementing the method.

FIELD OF ART

As is well known, a single- or two-ply wall insulation is utilized in the building industry to prevent absorption of ground moisture. During the course of erecting the building, the single-layer wall insulation is produced by placing, for example, tar paper in the dry state on the wall surface to be insulated, joining the extension zones by means of hot bitumen, pitch, or by bituminous or pitch-type protective coating. In the two-ply wall insulation, the insulating panels are glued onto the wall surface and one on the other with hot bitumen. The structural parts (e.g. the foundations, floors, roof shells) of the buildings are, in essence, insulated against moisture in a similar way.

The conventional insulating techniques have the deficiency in common that they require an enormous expenditure of labor on the side of the building industry at the construction site; they are not adequately durable, repetition of the leakproofing operation being connected with high costs and difficulties.

The need for subsequent leakproofing arises not only in old buildings, for example those of historical value, but also in buildings with brick walls, clay walls, even in buildings with concrete walls, to an ever increasing extent. At the present time, subsequent leakproofing in buildings with brick walls is performed by breaking out, in a length of 1 m, about four to five layers of bricks and, after the insulating paper has been arranged in place, rebuilding—insofar as possible—the broken-out material. The strong dynamic stresses (chiseling, knocking out) connected with the dismantling operation represent a not inconsiderable stress for the building which has deteriorated anyway; thus, the building structure is frequently damaged. A person skilled in the art is forced to perform this work, which requires special expertise, under accident-prone conditions since he must work by hand in the broken-out cavities of the wall, wherein the binder of such walls generally is rather brittle, where even the brick itself frequently exhibits a rather low strength.

A more up-to-date solution has been proposed for the subsequent insulation of walls wherein the wall is cut with a mechanical wall saw, for example with the aid of a chain saw, along sections thereof, and the layered insulating material is inserted in the thus-formed gap, wedged in place with load-bearing wedges, whereafter the remaining recess is filled with mortar.

The deficiency of the above solution resides in that, on the one hand, realization thereof is rather cumbersome; on the other hand, the binder cannot be supplied in the desired homogeneity. Furthermore, only a local, spotwise wall support can be provided by the wedging process; thus, stress centers and also cracks in the wall can be produced at these locations.

An electrical wall sealing method of experimental character has also been employed wherein, with an enormous consumption of energy and technical expenditure, the wall construction containing the absorbed moisture is electrically dried out.

Moreover, wall sealing methods having a chemical character have become known wherein materials, for example chemicals known commercially under the names of "VANDEX" or "PENETRAT" or "WALLCO" or "SILIKOFOB-ANHYDRO", are injected into the wall whereby the wall structure proper is impregnated, and the wall is provided with water-tight or water repellent properties. In this way, capillary moisture absorption of the wall is eliminated.

However, this method has not become popular inasmuch as, in each individual case, a thorough diagnostic preliminary examination is necessary. Only based on such a preliminary test is it possible for the experts to determine the individual technique, i.e. the location and number of bores to be made in the wall, the composition of the chemicals to be utilized, their amount, etc., whereby the quality of the insulation is basically determined. Additionally there is the fact that the chemicals in most cases are rather expensive, and if the test is not conducted in the critical period—taking into account the ground conditions (e.g. groundwater level), the seasons—the quality of the insulation will be inherently questionable. Furthermore, such a subsequent leakproofing is rather cumbersome and time-consuming.

Finally, the technical publication "Baugewerbe" [Building Trade] (FRG 1981, 11: 38–40) discloses a process for the subsequent insulation of a wall, during the course of which, in the first phase, the wall sections selected by the stress analyst, which are not proximate, are cut through, thereupon a panel of synthetic film is inserted in the cutout gap, whereafter the remaining gap is filled with a water-tight mortar. In general, the mortar will set after 24 hours and then can be exposed to loads. Now the second phase can follow, during which the wall sections left out in the first phase are cut through and sealed in the way described above. The synthetic resin films are joined at the junction zones with seam-sealing strips. Also the vacant sides of the cut gaps are sealed with strips.

As shown by experience gained under practical conditions, this technique proved likewise unsuitable for overcoming the aforementioned deficiencies. An additional disadvantage to be mentioned is that, when using a synthetic film panel, the upper and lower wall surfaces of the cut gaps cannot be joined with the mortar.

SUMMARY OF THE INVENTION

The object of the invention is to eliminate the above-mentioned deficiencies.

The problem on which this invention is based resides in developing a solution for leakproofing which can be realized during a substantially shorter time span, in a simpler way, even with semiskilled workers; a further requirement resides in that any damage to the building structure can be avoided during the subsequent insulation procedure, that the quality be higher and the lifetime longer than in the heretofore known solutions.

The thus-posed objective has been attained by the further development of a conventional method serving for wall insulation, during the course of which, while the wall is built up, an insulating layer is placed in the surface to be insulated. Along the lines of the invention, this method has been developed further insofar as the insulating layer is fashioned of load-bearing, prefabricated, grid-like insertion elements, as well as of an insulating material, optionally a hardening material, introduced into the openings of the installed insertion elements.

When performing a subsequent leakproofing operation, the starting point can be a conventional method wherein the wall, at the location to be insulated, is cut in sections in the longitudinal direction—advantageously by means of a saw—whereupon first load-bearing elements, thereafter an insulating layer are inserted in the thus-formed cut-out slots.

This process has been further developed, according to this invention, by utilizing as the load-bearing elements in the cut-out slot advantageously grid-like insertion elements prefabricated from a synthetic resin, the insulating layer being produced by injecting a material exhibiting insulating and hardening properties into the portion of the slots provided with the insertion elements.

Suitably, a post-hardening substance is used as the insulating and hardening agent, advantageously a synthetic mortar with polyester resin binder.

The insertion element of this invention is fashioned as a grid-like element prefabricated from an advantageously thermoplastic synthetic resin, this element exhibiting a carrier lattice and adjoining load-bearing units forming a unitary grid, the load-bearing units projecting beyond the upper and lower planes of the carrier lattice, respectively.

According to another feature of the invention, the load-bearing units can be balls rotatably arranged in the carrier lattice. By the way, the ball can be produced integrally as a unit with the supporting lattice, for example of a synthetic resin by the injection-molding method.

According to another feature of the insertion element of this invention, the elements are provided at their end faces with projections and with recesses receiving these projections, serving for the releasable connection to the adjoining insertion elements in the installed position.

In a preferred embodiment of the invention, the insertion element exhibits a continuously extending frame, the height of which is less than the height of the load-bearing element, advantageously amounting to about 0.9 times this latter height, but is simultaneously higher than the height of the carrier lattice; the frame is equipped with at least one injection bore.

BRIEF DESCRIPTION OF THE DRAWINGS

The invention will be explained in greater detail with the aid of the appended drawings, with reference to several advantageous examples of the solution of this invention. In the drawings.

PREFERRED EMBODIMENTS

Figure 1:
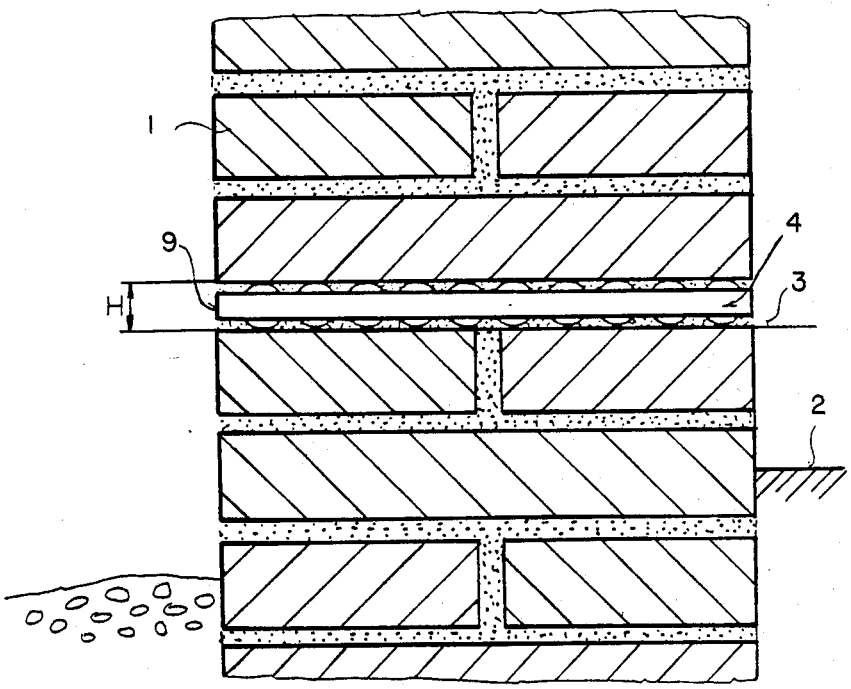
FIG. 1 shows a vertical section of the subsequent wall insulation according to this invention.

In FIG. 1, the insulation is shown pertaining to a load-bearing wall 1 built of brick, above a floor top edge 2, produced in the wall, devoid of satisfactory leakproofness, with the use of the method according to the invention.

First of all, the wall 1 is cut through at the level to be insulated in a manner known per se (for example by a chain saw) in the entirely horizontal cross section along a section having a length of between 60 and 110 cm—in the present case 100 cm—thus forming a cut-out slot 3 with a uniform height H. In the present case, the height H was selected to be 10.5 mm. In order to facilitate the cutting through operation, the cut-out slot 3 was made in the mortar layer of the wall 1. It seemed expedient to fashion the subsequent insulation at the location of the previous insulation. If such latter is not present, then it is proposed to make the cut-out slot 3 to be by at least 10–15 cm above the outside walk level. The choice of the individual length of the cut-out slot 3 depends, inter alia, on the quality, the material, of the wall.

Thereupon at least one prefabricated, grid-like insertion element 4 of this invention is inserted in the thus-prepared cut-out slot 3. In this instance, the width of the insertion element 4 coincides with the width of the wall 1. (Of course, in case of a wider wall, several insertion elements 4 can also be arranged side-by-side in the direction along the width.)

Figure 2:
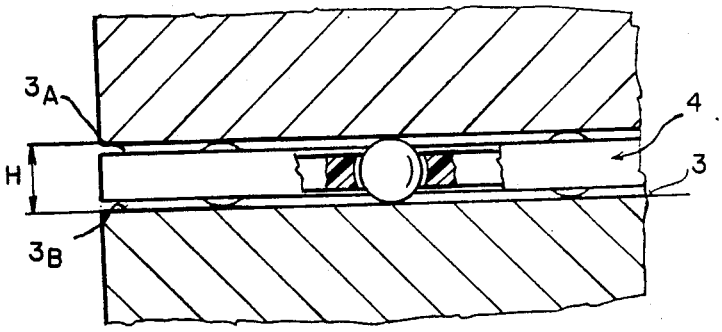
FIG. 2 shows part of the solution according to FIG. 1 on a relatively larger scale.

FIG. 2 shows the insertion element 4 employed on an enlarged scale; here, the upper and lower surfaces of the cut-out slots 3 are denoted by reference symbol 3A and 3B, respectively.

Figure 3:
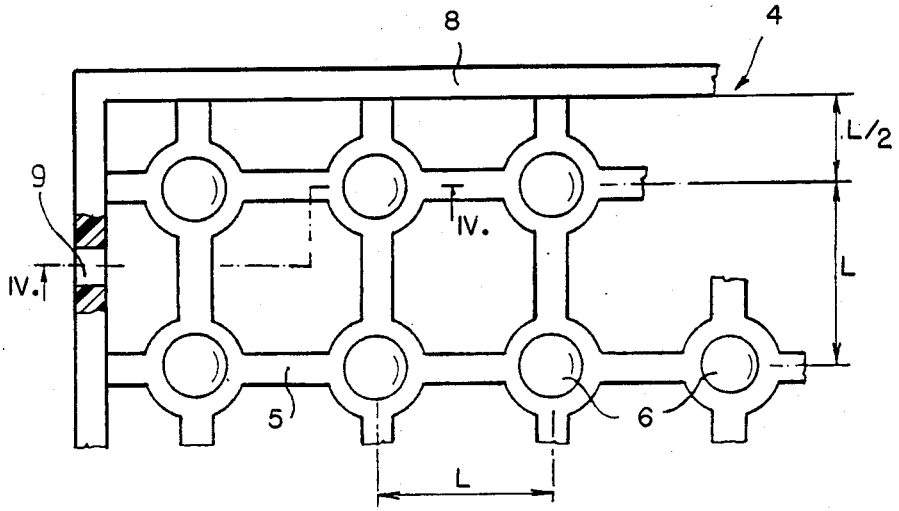
FIG. 3 shows a detail of the first embodiment of the insertion element of this invention, in a top view.
Figure 4:
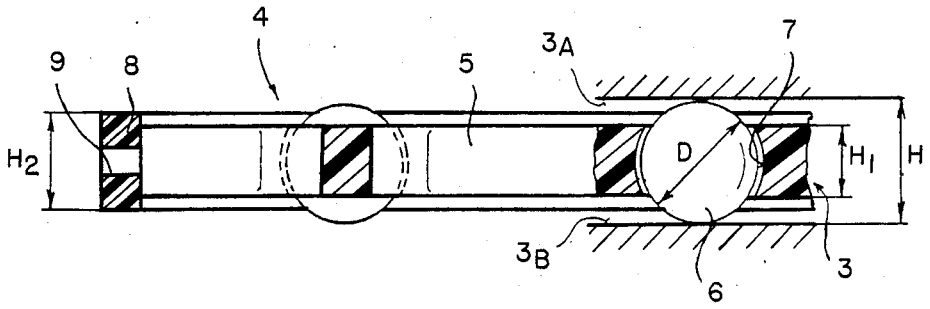
FIG. 4 shows a section along line IV—IV in FIG. 3.

The configuration of the insertion element 4 is illustrated in greater detail in FIGS. 3 and 4. In this embodiment, the insertion element 4 exhibits a carrier lattice 5 manufactured by the injection-molding method from a thermoplastic synthetic resin; this carrier lattice is equipped in the nodal points with the load-bearing units 6. In the present case, the load-bearing units 6 are independent balls which can be manufactured of a synthetic resin having a corresponding compressive strength (for example of "DANAMID") or of steel. We chose a ball diameter D of 10.0 mm for the cut-out slots 3 having a height of 10.5 mm, in order to be able to insert the ball-equipped insertion element 4 easily in the cut-out slots 3.

The load-bearing units 6 were provided to fulfill the task of absorbing the vertical load of the wall 1 in a uniform distribution after insertion of the insertion element 4 in the cut-out slot 3, thus preventing a possible damaging of the building construction during and after the subsequent insulating work.

The nodal points of the girder grillage 5 of the insertion element 4 are fashioned in this embodiment as nests 7 rotatably supporting the load-bearing units 6 (FIG. 4). In the present case, the mutual spacing L between the nests 7 was selected to be 30 mm (FIG. 3).

It is well known that in case of brick walls the weight of a 1 meter high wall section ranges, per $cm^2$, between 0.11 and 0.2 kg. Thus, in the instance of the above-mentioned insertion element 4, a single ball carries the weight of a vertical wall having a basal surface of 9 $cm^2$; in other words, a wall having a height of 1 m exerts on the ball a weight of between 1 and 2 kg. If, now, a building is considered having a height of 20 m, then a weight of at most 40 kg will be distributed to a single ball. (It is known, at the same time, that in case of thermoplastic synthetic resins the cold-flow load-bearing ability is 800–1,000 $N/cm^2$.)

By the embedding of the balls in the nest 7, inserting of the insertion element 4 in the cut-out slot 3 is facilitated, since the balls can freely rotate during this step. If the balls are dipped, for example, into water beforehand, the rolling resistance can be further reduced.

The height dimension (D) of the load-bearing units 6 is selected according to this invention so that these units project at the top and at the bottom beyond the carrier grillage 5. The height $H_1$ of the carrier grillage 5 was chosen in the present instance to be 0.7 times the ball diameter D, i.e. 7 mm (FIG. 4).

In the embodiment of FIGS. 3 and 4, the carrier lattice 5 of the insertion element 4 is surrounded by a continuous frame 8; in this case, its height dimension $H_2$ was selected to be 0.9 times the ball diameter D, i.e. 9 mm. Along the lines of this invention, the frame 8 is provided with at least one injection bore 9, this bore, after placing the insertion element 4, lying on the outside of the wall 1 (FIG. 1).

After the insertion element 4 has been pushed into the cut-out slot 3, the next working step of the process of this invention can follow, in the course of which a post-hardening material, for example, with insulating and setting properties is injected under a relatively low pressure via the injection bore 9 into the section of the cut-out slot 3 provided with the insertion element 4.

In this way, the cut-out slot 3 is entirely filled out, and also the insertion element 4 is embedded. Once the interior has been filled completely, and the injected material overflows through the lateral gaps, injection can be terminated.

The insulating and setting agent can be any known compound generally used for waterproofing, thus, for example, a leakproofing cement mortar (with a commercially available additive, e.g. "TRICOSAL" or "REZONIT"), or a synthetic mortar, advantageously with a polyester resin as the binder (for example synthetic mortar known on the market under the name of "POLISOL"). The great advantage of the last-mentioned mortar shows itself in that it sets extremely rapidly (within about 60–90 minutes) whereby the time required for the leakproofing work can be substantially shortened.

The compressive strength of the synthetic mortars with polyester resin as the binder is 3,000–6,000 N/cm$^2$, which extensively surpasses the compressive strength of the baked bricks (amounting to 2,000 N/cm$^2$), the adhesive strength being 300–400 N/cm$^2$.

After elapse of the waiting period—depending on the type of insulating and binding agent injected and on the ambient temperature—(according to practical experience, the period required is about 2–3 hours)—the insulating and binding agent is set whereby it likewise participates in the load-bearing process. Of course, the insertion element 4 of this invention also partakes in the load-bearing on account of its load-bearing units 6.

Thereupon another cut-out slot 3 is made by a chain saw in the neighboring zone, and the above-described operating steps are cyclically repeated until the post wall insulation has been completed.

The use of a ball as the load-bearing unit 6 is to be considered expedient not only because insertion is facilitated but also because in this way a spotwise contact is made possible with the surfaces of the cut-out slot 3. The thus-injected material is capable of coming into contact with the cut faces of the wall 1 along a maximally large surface area whereby an optimum adhesive bond is produced.

For the sake of good order, it should be noted that, in the embodiment of FIGS. 3 and 4, the carrier grillage 5 and the frame 8 of the insertion element 4 are manufactured of a single workpiece by injection-molding.

Figure 5:
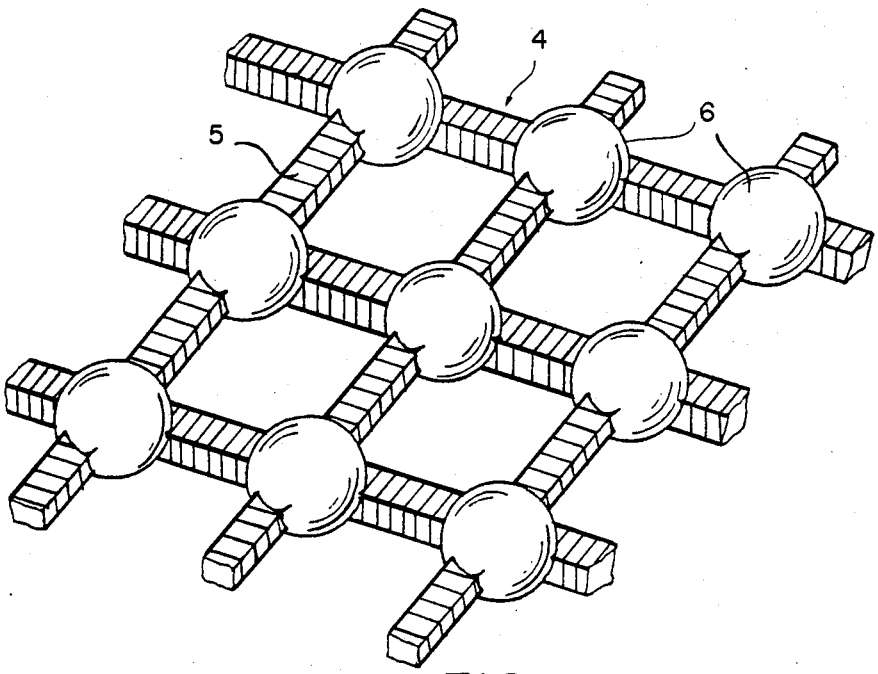
FIG. 5 shows another version of the insertion element of this invention in a perspective illustration.

In FIG. 5, another version of the insertion element 4 according to this invention is illustrated wherein likewise balls are employed as the load-bearing units 6, but these balls are not rotatably arranged in the carrier lattice 5 but rather are injection-molded integrally therewith to form a single unit. Of course, in this case, it is possible to use, in place of the balls, for example, conical or pyramid-like plugs as the load-bearing unit 6. (In FIG. 6, we denoted the already injected insulating and setting agent by numeral 10.)

Figure 6:
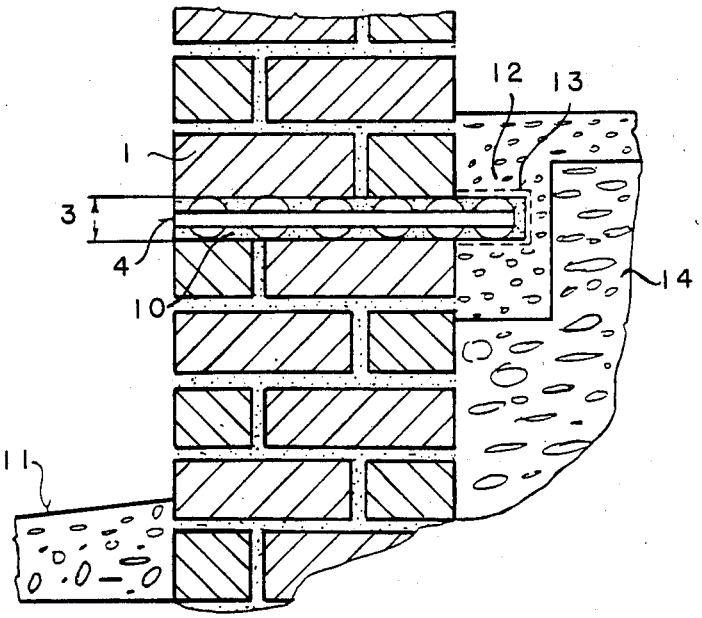
FIG. 6 is a vertical section of the wall insulation of this invention below the top edge of the floor.

FIG. 6 illustrates the subsequent wall insulation below the top edge of the floor. In this arrangement, the wall 1 is likewise built up of bricks (the external walk level was denoted by 11). As compared with the solution shown in FIG. 1, the only difference resides in that the cut-out slot 3 traverses not only the entire cross section of the wall but is also continued in the thickened part of a sub-concrete 12 beside the wall 1. The width of the insertion element 4 was also selected correspondingly. By injection of the insulating and hardening agent 10, a more extended leakproofing is obtained in this embodiment; this avoids that, at the junction of the wall 1 and the sub-concrete 12, moisture could seep upwardly. (The surface of the sub-concrete is conventionally provided, for example, with a bituminous sealing layer.)

The solution of FIG. 6 can, however, be utilized not only for subsequent leakproofing but also for new insulations. In this case, the insertion elements 4 are placed on the wall, built up to the insulating level; the portion extending into the sub-concrete 12, to be produced later on, can be covered, for instance, with a U-shaped sheet-metal casing 13, denoted in the figure with a broken line. After the insertion elements 4 have been packed with the insulating and sealing agent 10, which is, for example, post-hardening, a new layer of bricks is placed on the insertion elements. The insulating and hardening agent can, of course, be injected also in this case via an injection bore 9, but for this purpose at least one layer of bricks must be laid on top of the insertion elements 4. After the wall insulation has been completed, the sub-concrete 12 is produced which is placed on the fill 14.

Figure 7:
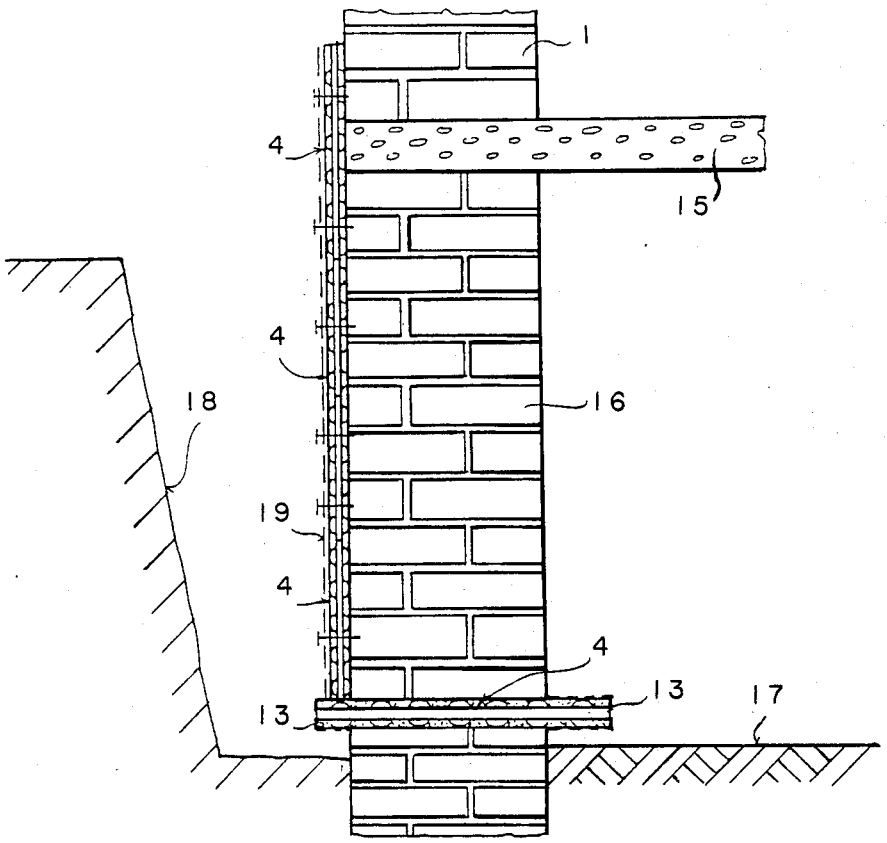
FIG. 7 is a vertical section of another version of the insulation according to this invention.

FIG. 7 shows the leakproofing for a cellar which can be designed, using the method of this invention, either as a subsequent or a new insulation. In this version, the wall seal is arranged in a basement wall 16—supporting the wall 1 above a basement ceiling 15—namely above a cellar floor 17. In order to make the basement wall 16 accessible from the outside, a working ditch 18 must be provided. In the present case, we used a sheet-metal casing 13 on the outside as well as on the inside for encasing the projecting ends of the insertion element 4. Otherwise, the procedure of producing the leakproofing is the same as in FIG. 6. (The basement floor 7 is subsequently equipped, in a manner known per se, with an insulating layer, not shown.)

In the embodiment of FIG. 7, a vertical leakproofing system according to this invention is arranged—besides the horizontal insulation—also in the basement wall 16 and part of the wall 1 on the outside. For this purpose, the insertion elements 4 were likewise employed, namely by attaching the insertion elements 4, placed in superimposed and side-by-side relationship, to the wall by means of screw or nail connection, for example. The outer surface of the insertion elements 4 is sealed with a dense synthetic screen mesh 19 to be able to prevent escape of the insulating material, but at the same time affording the vapors a possibility for escape. Optionally, a synthetic resin sheet can be spread out underneath the insertion elements 4.

Figure 8:
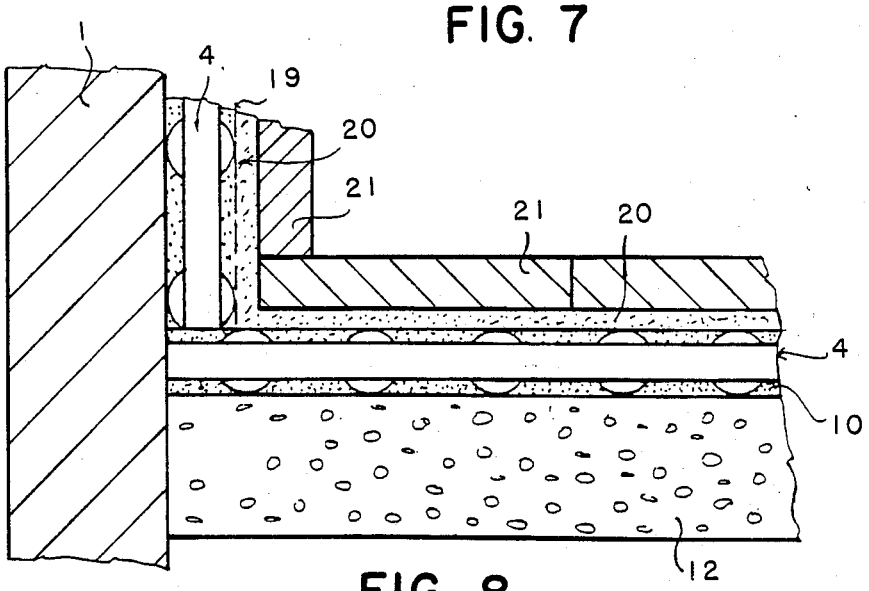
FIG. 8 is a vertical section of the insulation according to this invention in case of a moist space.

Finally, FIG. 8 shows a further embodiment of the invention which can be used successfully in the insulation of moist spaces. Here again the leakproofing can be effected subsequently or as a new insulation. First of all, the insertion elements 4 are placed on a rough concrete 12 after which "POLISOL" is applied as the sealing compound After hardening of the sealing compound, the insulation of the inner surface of the wall 1 was produced as described in connection with FIG. 7, i.e. a synthetic screen mesh 19 was utilized. After the insulating agent had hardened, the horizontal and vertical inner surfaces were conventionally lined with tiles 21 glued in place by adhesive 20.

As can clearly be seen from the above, the invention is nowise limited to wall insulation; it can be utilized advantageously for any leakproofing purposes.

The most important advantages of the solution according to this invention are the following:

The insertion element 4 can be manufactured inexpensively, for example from synthetic resin scraps in an injection-molding process on an industrial scale. In view of the fact that the insertion element has a sufficiently flexible structure, the insulation of this invention produced with the insertion elements can readily adapt to possible dilation movements of the wall—while maintaining the original function;

The proposed wall insulation is completely watertight; as compared with the conventional solutions, lifetime is much longer, the strength is higher than that of the conventional wall element;

As compared with the conventional solutions, the work can be performed much faster and in a much simpler fashion, presenting no problem for semiskilled workers;

The insertion element of this invention provides uniform load distribution, thus reducing the probability of damage to the building structure to a minimum. Thanks to this gentle character, the invention can be used entirely safely in the subsequent insulation of art objects etc.

As compared with the conventional methods, the costs for performing this method are much lower;

The insulation of this invention is not plasticized under the effect of heat;

The solution of this invention satisfies the strictest requirements regarding insulating technique and strength.

Finally, it should be noted that the insertion element 4 can be manufactured, besides being made of a synthetic resin, of any suitable material. If, for example the insertion element according to FIG. 5 is utilized for the subsequent wall insulation as shown in FIG. 6, the frame 8 of the insertion element can be omitted. Since in this case it is merely necessary to seal the outside of the cut-out slots 3, the application of a layer of synthetic mortar is sufficient. Once the mortar has set, the injection bore is made through which injection can be effected. In order to be able to releasably join the insertion element 4 with the neighboring insertion elements, these elements are provided at the rims with projections and, respectively, with recesses receiving the projections (not shown in the figure). The insertion element according to FIG. 5 can also be manufactured in rolls of a synthetic resin; afterwards, sectioning and cutting to size can be simply performed on the building site. The insulating and setting agent used need not absolutely be a post-hardening material since the load-bearing proper is adequately provided by the insertion elements of this invention.

I claim:

1. A method for the subsequent leakproofing of building walls, comprising cutting a slot through a building wall at the site of the desired leakproofing, then inserting in said slot a grid-like insertion element comprising a carrier lattice having load-bearing balls arranged in a grid pattern, upper and lower portions of the balls projecting beyond the carrier lattice, and injecting a material having leakproofing and setting properties into the slot to embed the insertion element and the balls therein.

2. A method as claimed in claim 1, in which said material is a synthetic mortar with a polyester resin binder.

* * * * *